US005366648A

United States Patent [19]

Salomon et al.

[11] Patent Number: 5,366,648

[45] Date of Patent: Nov. 22, 1994

[54] FUNCTIONAL FLUIDS USEFUL AT HIGH TEMPERATURES

[75] Inventors: Mary F. Salomon, Cleveland Heights; Donald J. Marn, Wickliffe; Franklin P. Abbott, Middleburg Hts.; Joseph W. Pialet, Euclid, all of Ohio

[73] Assignee: The Lubrizol Corporation, Wickliffe, Ohio

[21] Appl. No.: 484,338

[22] Filed: Feb. 23, 1990

[51] Int. Cl.[5] ..... C10M 1/38

[52] U.S. Cl. ..... 252/42.7; 252/56 S; 252/52 R; 252/49.6; 252/49.7

[58] Field of Search ..... 252/56 S, 52 R, 42.7, 252/49.6, 49.7

[56] References Cited

U.S. PATENT DOCUMENTS

| | | | |
|---|---|---|---|
| 2,174,110 | 9/1939 | Reed | 260/400 |
| 2,202,781 | 5/1940 | Kennedy | 180/78 |
| 2,239,974 | 4/1941 | Reed | 252/161 |
| 2,319,121 | 5/1943 | Fox | 260/513 |
| 2,337,552 | 12/1943 | Henke | 260/513 |
| 2,801,968 | 8/1957 | Furley et al. | 252/32.5 |
| 3,231,499 | 1/1966 | Smith | 252/57 |
| 3,247,111 | 4/1966 | Oberright | 252/34.7 |
| 3,267,031 | 8/1966 | Buehler | 252/18 |
| 3,278,436 | 10/1966 | Dazzi et al. | 252/50 |
| 3,280,031 | 10/1966 | Brennan et al. | 252/49.8 |
| 3,293,180 | 12/1966 | Axworthy | 252/28 |
| 3,340,286 | 9/1967 | Schiefer et al. | 260/448.2 |
| 3,347,791 | 10/1967 | Thompson et al. | 252/33.6 |
| 3,372,116 | 3/1968 | Meinhardt | 252/36 |
| 3,410,798 | 11/1968 | Cohen | 252/37.2 |
| 3,488,284 | 1/1970 | LeSuer et al. | 252/33 |
| 3,595,790 | 7/1971 | Norman et al. | 252/32.7 |
| 3,673,226 | 6/1972 | Malec | 260/410.6 |
| 3,798,012 | 3/1974 | LeSuer | 44/51 |
| 3,912,640 | 10/1975 | Anzenberger | 252/47.5 |
| 3,931,023 | 1/1976 | Dounchis | 252/49.8 |
| 4,021,419 | 5/1977 | Karn | 260/128 |
| 4,049,563 | 6/1977 | Burrous | 252/49.9 |
| 4,308,154 | 12/1981 | Clason et al. | 252/46.7 |
| 4,326,972 | 4/1982 | Chamberlin | 252/33.3 |
| 4,396,517 | 8/1983 | Gemmill, Jr. et al. | 252/51.5 A |
| 4,417,990 | 11/1983 | Clason et al. | 252/46.7 |
| 4,519,927 | 5/1985 | Seiki | 252/49.6 |
| 4,579,672 | 4/1986 | Brecker et al. | 252/49.8 |
| 4,785,095 | 11/1988 | Salomon | 544/38 |
| 4,800,031 | 1/1989 | DiBiase et al. | 252/47 |

FOREIGN PATENT DOCUMENTS

| | | |
|---|---|---|
| 0294096 | 12/1988 | European Pat. Off. . |
| WO8701722 | 3/1987 | WIPO . |

*Primary Examiner*—Prince Willis, Jr.
*Assistant Examiner*—Jim Silbermann
*Attorney, Agent, or Firm*—James L. Cordek; Frederick D. Hunter, Sr.; Joseph P. Fischer

[57] ABSTRACT

Functional fluids characterized as effective over a wide range of temperature including very high temperatures can be prepared, comprising:

(A) a major amount of at least one synthetic base oil; and minor amount of (B) at least one phenolic compound selected from the group consisting of (B-1) metal-free, hindered phenols substituted with at least one alkyl group containing at lease about 6 carbon atoms, and alkylene coupled derivatives thereof;

(B-2) neutral and basic alkaline earth metal salts of hindered phenols which are not alkylene or sulfur-coupled;

(B-3) metal-free alkyl phenol sulfides or neutral and basic alkaline earth metal salts of alkyl phenol sulfides; and (B-4) neutral and basic alkaline earth metal salts of alkylene-coupled phenols; and (C) at least one non-phenolic antioxidant.

33 Claims, No Drawings

FUNCTIONAL FLUIDS USEFUL AT HIGH TEMPERATURES

TECHNICAL FIELD

This invention relates to novel compositions which are particularly suitable for use as functional fluids, i.e., hydraulic fluids, heat-transfer fluids, synthetic lubricants, etc., useful at high temperatures such as above 260° C. More specifically, the invention relates to novel compositions which are particularly useful in extremely high temperature applications up to about 370° C. or even 540° C. or higher.

BACKGROUND OF THE INVENTION

There is a continuing need for functional fluids which are capable of functioning at temperature extremes such as from sub-zero temperatures to 540° C. or higher. For example, synthetic lubricants for jet engines and experimental low heat rejection engines such as adiabatic engines, hydraulic fluids for supersonic aircraft and coolants for electronic equipment are required to function over this wide range of temperatures. These temperature range requirements present difficult problems of developing compositions which are liquid and thermally stable at the very high temperatures, and which remain in liquid form at low temperatures. It is also necessary to design materials which have adequate temperature-viscosity properties and lubricity and which have adequate lubricating characteristics within the entire temperature range.

Piston engines used in automobiles or generally as power sources usually have water or air-cooled cylinders in order to keep the cylinder walls cool enough to permit oil lubrication of the piston. Lubricating oil compositions primarily based upon mineral oils and including various chemical additives have been effective lubricants of the present combustion engines.

Automotive engineers, however, are developing a new generation of engines that are expected to be more powerful, use less fuel, weigh less and be smaller than existing engines. These future engines are being designed to operate at exceedingly high temperatures since it has been established that when engines run at higher temperatures, fuel efficiency increases. The high temperatures in the new engines will be attained by removing the cooling system from the engine which will also allow the engines to be smaller.

Most present-day lubricants based upon mineral hydrocarbon oils cannot withstand such high temperatures or perform satisfactorily at such high temperatures because the mineral oil decomposes or is volatile thereby leaving the movable engine parts poorly lubricated. Additionally, the decomposition of the mineral oil results in the formation of deposits. An ideal lubricating fluid for the expected high temperature or "adiabatic" engines should possess most if not all of the following characteristics: good deposit prevention low volatility, high thermal stability, good oxidative stability, satisfactory corrosion control, good wear control, satisfactory friction control, and acceptable viscometrics.

Various lubricants have been suggested in the prior art for use at temperatures of up to about 200° C. or 230° C. including the lubricants which have been used to lubricate moving parts of jet and turbo-jet engines. Most of the lubricants which have been suggested for use and which have been effective in lubricating jet engines have utilized high boiling synthetic oils as the base stock. Synthetic esters derived from polyhydroxy compounds and various compounds containing reactive carboxylic acid groups have been suggested as useful base oils for lubricants to be used at high temperatures such as obtained in jet engines. For example, U.S. Pat. Nos. 3,231,499; 3,340,286; 3,347,791; 4,049,563; and 4,519,927 describe the use of various synthetic esters, either alone or in combination with other materials such as synthetic ethers and silicones in high temperature lubricants. Generally, the lubricants will contain various chemicals to improve various properties including thermal stability, oxidation stability, reduced deposit formation, etc. For example, detergents and dispersants for use in synthetic ester lubricants are described in U.S. Pat. Nos. 3,231,499; 3,347,791; and 4,519,927. Alkali metal salts of carboxylic acids and hydroxyl-containing aromatic compounds are described in the '791 patent as useful detergents, and calcium stearate is an example found therein.

U.S. Pat. No. 4,519,927 describes lubricants useful at high temperatures and which comprise a mixture of an aryl alkyl silicone and a fatty acid ester of a hindered alcohol such as trimethylol propane or pentaerythritol. The patentees indicate that the lubricants, may contain other additives such as amine-, phenol-, and dithiophosphoric acid-type antioxidants, sulfonate-, phenate-, phosphonate-, and salicylate-type detergents, dispersants, sulfur/phosphorus-, and phosphate-type extreme pressure agents, and oiliness agents. Such additives are illustrated in the examples by phenothiazine, calcium sulfonate (TBN=25), calcium phenate (TBN=150), barium phosphonate (TBN=170), and tricresylphosphate. Examples of amine antioxidants described in this patent include phenyl-alpha-naphthylamine and phenothiazine.

The use of high boiling synthetic ethers as base oils for lubricants for jet engines is described in U.S. Pat. No. 2,801,968, and polyolefins such as polyalphaolefins are described as useful base stocks in high temperature lubricants in U.S. Pat. No. 3,280,031. The use of silicon fluids, either alone or in combination, as base oils for high temperature lubricants is described in, for example, U.S. Pat. Nos. 3,267,031; 3,293,180; and 4,049,563.

Published European Patent Application 0294096 describes lubricants based on natural or synthetic basestocks which contain a high molecular weight carboxylic dispersant and a metal detergent which may be a neutral or basic sulfurized alkyl phenol. The lubricants may contain other additives such as antioxidants. Examples of antioxidants include calcium nonyl phenol sulfide, dioctyldiphenyl amine and phenyl alpha-naphthyl amine.

WO 87/01722 describes diesel lubricants containing a natural or synthetic basestock containing a carboxylic derivative dispersant and a basic alkali metal salt. The lubricants may contain other additives such as metal dithiophosphates, various detergents including metal carboxylates, sulfonates and phenates, and antioxidants. One example of a metal detergent is a basic calcium salt of a sulfurized tetrapropenyl phenol, and an alkylated aromatic amine is also included in the oil.

High temperature jet lubricants are described in U.S. Pat. No. 3,247,111 which comprise a major proportion of a synthetic ester, minor amounts of various additives including antioxidants which include amines, phenols, esters, phosphites, etc. Examples of antioxidants described in this patent include diaromatic amines such as dinaphthyl amine, and hindered phenols such as 2,4-di-tertiarybutyl p-cresol, etc. Combinations of different diaromatic amines are described as being preferred.

U.S. Pat. No. 3,278,436 describes lubricants containing certain melamine derivatives as an essential lubricating ingredient in combination with other lubricants which include synthetic esters. Antioxidants are also included in the lubricating compositions to hinder the auto oxidation which occurs at temperatures above 150° C. Cyclic aromatic amines and hydroxy-substituted aromatics are described as useful antioxidants. Of the antioxidants in the class of hydroxyl-substituted aromatics, hindered phenols such as 2,6-di-tert-butyl-4-ethyl phenol and methylene coupled hindered phenols such as 2,2'-methylene-bis-(4-methyl-6-tert butyl phenyl) are identified. Synthetic ester lubricants also containing antioxidants which may be aromatic amines or of the phenolic type are also described in U.S. Pat. No. 3,673,226. Synthetic ester-based gas turbine lubricants containing diaromatic amines and methylene coupled phenols such as 4,4'-methylene-bis(2,6-di-t-butyl phenyl) are described in U.S. Pat. No. 3,912,640. The base stock utilized in the preparation of these lubricants comprise a blend of a synthetic ester and a low viscosity mineral oil. The amount of mineral oil may range from about 20 to about 80% of the base stock.

SUMMARY OF THE INVENTION

It has now been discovered that functional fluids characterized as effective over a wide range of temperature including very high temperatures can be prepared which comprise (A) a major amount of at least one synthetic base oil; and minor amounts of (B) at least one phenolic compound selected from the group consisting of (B-1) metal-free, hindered phenols substituted with at least one alkyl group containing at least about 6 carbon atoms, and alkylene coupled derivatives thereof;

(B-2) neutral and basic alkaline earth metal salts of hindered phenols which are not alkylene-or sulfur-coupled;

(B-3) metal-free alkyl phenol sulfides or neutral and basic alkaline earth metal salts of alkyl phenol sulfides; and (B-4) neutral and basic alkaline earth metal salts of alkylene-coupled phenols; and (C) at least one non-phenolic antioxidant. When the phenolic compound (B) is a metal-free or neutral phenolic compound, it is preferred to include as an additional component, (D) at least one basic alkali metal salt or alkaline earth metal salt of a sulfonic or carboxylic acid, or mixtures thereof. In one preferred embodiment, the high temperature functional fluids of the invention are free of ashless dispersants or metal salts of dihydrocarbyl dithiophosphoric acids, or both.

The lubricating compositions of the present invention are particularly useful at high temperatures such as above 260° C. including high temperature applications of up to about 370° C. or even 540° C. or higher. The functional fluids of the invention retain their lubricating properties and are thermally stable at the very high temperatures.

DESCRIPTION OF THE PREFERRED EMBODIMENTS (A) Synthetic Base Oil.

The synthetic base stocks utilized in the preparation of the functional fluids of the present invention may be any of the known synthetic oils previously used as base stocks in high temperature applications provided that they exhibit good high and low temperature characteristics, and, in particular, those synthetic oils which are liquid and maintain their lubricating properties at temperatures of at least about 500° F. Examples of synthetic fluids which can be used as the base oil and the functional fluids of the present invention include polyol esters, polyolefins (particularly hydrogenated polyalphaolefins), silicon-based oils, esters of phosphorus-containing acids, polyethers, etc.

In one embodiment, the preferred synthetic base oils are the polyol esters obtained by reacting various polyhydroxy compounds with carboxylic acids. When the carboxylic acids are dicarboxylic acids, mono-hydroxy compounds can be substituted for the polyols. For example, useful synthetic esters include the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols with alkanoic acids containing at least 4 carbon atoms. The polyhydric alcohol may be represented by the formula $$(RCH_2)_3—C—CH_2O[CH_2—C(CH_2R)_2—CH_2—O]_nR' \quad (I)$$

wherein each R is independently a hydrogen atom, a hydroxyl group, a hydroxyalkyl group, an alkyl group, or an alkoxy group, R' is hydrogen or an alkyl group, and n is an integer from 0 to 4, provided that at least two of the R groups are hydroxy or hydroxyalkyl groups, and when n is 0, R' is R. The polyhydric alcohols of the type represented by Formula I are generally referred to as hindered aliphatic alcohols. The alkyl, alkoxy and hydroxy alkyl groups in Formula I generally are lower alkyl groups and more generally will contain from about 1 to about 3 carbon atoms. Preferred examples of the hindered polyhydric alcohols when n=0 include: trimethylol ethane, trimethylol propane, trimethylol butane, pentaerythritol, neopentyl glycol, 2-methyl-2-propyl-1,3-propanediol, etc. In addition, hindered alcohols of the type represented by Formula I include compounds such as: di-trimethylol propane and dipentaerythritol (where n=1); and tri-trimethylolpropane and tripentaerythritol (where n=2). Generally, the di- and tri-derivatives are mixtures of the mono-, di-, tri-, etc., derivatives and n may be expressed as being an average of from 0.5 to about 1.5 or 2 in the mixture.

The alkanoic acids which are reacted with the polyhydric alcohols generally contain at least about 4 carbon atoms, and examples of such alkanoic acids include fatty acids which contain from 5 to about 30 carbon atoms such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid. For high temperatuare stability, it is preferred to avoid the use of unsaturated acids.

The most suitable synthetic ester oils are the esters of trimethylol propane, trimethylol butane, trimethylol ethane, pentaerythritol and/or dipentaerythritol with one or more monocarboxylic acids containing from about 5 to about 10 carbon atoms. Exemplary synthetic ester fluids which are commercially available include Hercolube A (believed to be an ester of pentaerythritol and a mixture of $C_{5-9}$ fatty acids), Hercolube B, Hercolube C, Hercolube F (believed to comprise a dipentaerythritol ester of $C_{5-9}$ fatty acids), Hercolube J, and Hercolube 202, all marketed by Hercules Incorporated; Unilever 14.636 and Unilever 14.735, marketed by Unilever Corporation; and Stauffer Basestocks 700, 704 and 800 marketed by Stauffer Chemical Company.

The synthetic ester fluids may be prepared by reacting the polyhydric alcohol with a slight excess of the alkanoic acid or acids. Although it is not necessary to use a catalyst, a suitable catalyst such as p-toluene sulfonic acid, benzene sulfonic acid, zinc or lead salts can be employed. The esterification reaction may be conducted at a temperature between 180° and 240° C. for a period of between 6 to 14 hours. When a catalyst is present, temperatures of about 120° C. are sufficient. Water is eliminated by evaporation during the course of the reaction, and the removal may be facilitated by the presence of an azeotropic agent such as a fluid hydrocarbon.

Silicon-based oils such as the polyalkyl-, polyaryl-, polyalkoxy-, and polyaryloxy-siloxane oils and silicate oils comprise another useful class of synthetic base oils. Examples of the silicate oils include tetraethyl silicate, tetraisopropyl silicate, tetra-(2-ethylhexyl) silicate, tetra-(4-methyl-hexyl) silicate and tetra-(p-t-butyl-phenyl) silicate. In one preferred embodiment, the silicon-based oils are polysilicones such as alkyl phenyl silicones or siloxanes. The alkyl phenyl silicones can be prepared by the hydrolysis and condensation reactions as described in the art such as, for example, in *An Introduction to the Chemistry of the Silicones*, by Eugene G. Rochow, John Wiley & Sons, Inc., New York, Second Edition (1951).

The silicone-containing fluids may be polysiloxanes having units of the general formula $$R_nSiO_{4-n/2}$$

wherein n has a value from about 1.1 to about 2.9 and R represents the same or different organyl groups. Some examples of such organyl groups are: hydrocarbons including aliphatic groups, e.g., methyl, propyl, pentyl, hexyl, decyl, etc., alicyclic groups, e.g., cyclohexyl, cyclopentyl, etc., aryl groups, e.g., phenyl, naphthyl, etc., aralkyl groups, e.g., benzyl, etc., and alkaryl groups, e.g., tolyl, xylyl, etc.; the halogenated, oxygen-containing, and nitrogen-containing organyl groups including halogenated aryl groups, alkyl and aryl ether groups, aliphatic ester groups, organic acid groups, cyanoalkyl groups, etc. The organyl groups, in general, contain from 1 to about 30 carbon atoms.

Of particular interest are polysiloxane fluids containing organo-siloxane units of the above formula wherein R is selected from the group of (a) alkyl groups, e.g., methyl, (b) mixed alkyl and aryl, e.g., phenyl groups, in a mole ratio of alkyl to aryl from about 0.5 to about 25, (c) mixed alkyl and halogenated aryl groups, e.g., chlorinated, brominated phenyl, in a mole ratio of alkyl to halogenated aryl of from 0.5 to about 25 and mixed alkyl, aryl and halogenated aryl groups in a mole ratio of alkyl to total aryl and halogenated aryl from about 0.5 to about 25. The halogenated aryl groups in all cases contain from 1–5 halogen atoms each. These silicone fluids may, of course, also be physical mixtures of one or more of the polysiloxanes in which R is as defined above.

The viscosity of the silicone fluids will vary depending upon the starting materials, their method of preparation etc. In general, the fluids may possess molecular weights of from about 200 to about 10,000.

In one embodiment, the alkyl phenyl silicon base oils useful in the present invention may be represented as containing repeating units represented by the general formula

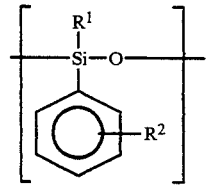

(II)

wherein $R^1$ is an alkyl group containing from 1 to about 6 carbon atoms and $R^2$ is a hydrogen atom, halogen, or an alkyl group containing from 1 to 3 carbon atoms.

Specific examples of the alkyl phenyl polysiloxanes of the type containing the repeating structure (II) include methyl phenyl silicone, methyl tolyl silicone, methyl ethylphenyl silicone, ethyl phenyl silicone, propyl phenyl silicone, butyl phenyl silicone and hexyl propylphenyl silicone.

The alkyl phenyl silicones of the type described above generally are characterized as having molecular weights within the range of about 500 to 4000. Generally, however, the size of the molecule is not expressed with reference to the molecular weight, but, rather, by reference to a viscosity range. For example, the alkyl phenyl silicones useful in the present invention may have kinematic viscosities ranging from about 20 to about 2000 centistokes at 25° C., and preferably from about 75 to about 500 centistokes at 25° C.

Alkyl phenyl silicones of the type useful in the present invention are commercially available from Dow Corning Corporation, the General Electric Company and others. Specific examples of methyl phenyl silicones which may be employed in the present invention include SF-1153 from General Electric Company having a viscosity at 25° C. of 100 centistokes. Another synthetic silicone is a methyl phenyl polysiloxane sold by General Electric Company under the tradename SF-1038. The viscosity of this material at 25° C. ranges from about 50 to about 500 centistokes. Other suitable methyl phenyl polysiloxanes are those marketed by Dow Corning as Dow Corning 550 Fluid which has a viscosity at 25° C. of about 100 to 150 centistokes, and Dow Corning 710 Fluid having a viscosity at 25° C. of about 500 centistokes. Alkyl phenyl silicones also are available from the Toray Company Ltd., under such designations as silicone SH500 (30 centistokes), and silicone SH203 (150 centistokes), and these are reported to be methyl phenyl silicone and hexyl 4-propylphenyl silicone, respectively.

Synthetic saturated hydrocarbon oils also may be utilized as the base oil or one of the base oils in the functional fluids of the present invention. It is important that the hydrocarbon oils are saturated and thus, oils prepared by polymerizing unsaturated monomers (e.g., ethylene) are hydrogenated prior to use to remove any unsaturation from the synthetic oil. Examples of the saturated hydrocarbon oils, which include halo-substituted hydrocarbon oils, are the hydrogenated polymerized and interpolymerized olefins such as fluid polyethylenes, polypropylenes, polybutylenes, propylene-isobutylene copolymers, chlorinated polybutylenes, poly(1-hexenes), poly(1-octenes), poly(1-decenes); polymers of alkyl benzenes such as dodecylbenzenes, tetradecylbenzenes, dinonylbenzenes, di-(2-ethyl-hexyl)-benzenes, etc.; polyphenyls such as biphenyls, terphenyls, alkylated polyphenyls, etc.; alkylated diphenyl ethers and alkylated diphenyl sulfides and the derivatives, analogs and homologs thereof. The hydrogenated polyolefins derived from alpha aliphatic olefins such as ethylene, propylene, 1-butene, etc., are preferred examples of polyolefins useful as the synthetic base oil. Fluid hydrogenated polyolefins useful as synthetic base oils are available commercially from a number of sources including Mobil Oil (e.g., "SHF-82") and Emery Industries (e.g., "Emery 3000"and "Emery 3010").

Examples of esters of phosphorus-containing acids which are useful as synthetic base oils in the present invention include triphenyl phosphate, tricresyl phosphate, trixylyl phosphate, trioctyl phosphate, diethyl ester of decane phosphonic acid, etc.

Synthetic polyethers are also useful as the synthetic base oil in the functional fluids of the present invention. In one embodiment, the polyethers may be polyphenyl ether fluids which have a wide liquid range and remain in the liquid phase at temperatures of from below 100° F. up to 800° F. or higher. The polyphenyl ethers may contain from 3 to 7 benzene rings and from 2 to 6 oxygen atoms, and the oxygen atoms join the benzene rings in chains as ether linkages. One or more of the benzene rings may be hydrocarbyl-substituted. The hydrocarbyl substituents, for thermal stability, must be free of $CH_2$ and aliphatic CH groups so that the preferred aliphatic substituents are lower saturated hydrocarbon groups (1 to 6 carbon atoms) such as ethyl and t-butyl. Preferred aromatic substituents are aryl groups such as phenyl, tolyl, t-butyl phenyl and alphacumyl. Polyphenyl ethers consisting exclusively of chains of from 3 to 7 benzene rings with at least two oxygen atom joining the benzene rings in the chains as an ether linkage have particularly desirable thermal stability. Examples of the polyphenyl ethers containing aliphatic carbons which are suitable for high temperature base fluids are 3-ring polyphenyl ethers such as 1-(p-methylphenoxy)-4-phenoxy benzene and 2,4-diphenoxy-1-methyl benzene; 4-ring polyphenyl ethers such as bis[p-(p-methylphenoxy) phenyl] ether and bis[p-(p-t-butylphenoxy) phenyl] ether, etc.

The above-described polyphenyl ethers can be obtained by known procedures such as, for example, the Ullmann ether synthesis which broadly relates to ether-forming reactions wherein alkali metal phenoxides such as sodium and potassium phenoxide are reacted with aromatic halides such as bromobenzene in the presence of a copper catalyst such as metallic copper, copper hydroxide or copper salts. An example of a commercially available polyether is a polyphenyl ether available from Monsanto under the designation "OS-124".

Alkylene oxide polymers and interpolymers and derivatives thereof wherein the terminal hydroxyl groups have been modified by esterification, etherification, etc., constitute another class of synthetic lubricating oils that can be utilized as the base oil in the functional fluids. These fluids may be exemplified by the oils prepared through polymerization of ethylene oxide or propylene oxide, the alkyl and aryl ethers of these polyoxyalkylene polymers such as methyl polyisopropylene glycol ether having an average molecular weight of about 1000, diphenyl ether of polyethylene glycol having a molecular weight of about 500 to 1000, diethyl ether of polypropylene glycol having a molecular weight of about 1000 to about 1500.

The amount of synthetic base oil included in the high temperature functional fluids of the present invention is a major amount. By major amount is meant an amount greater than 50% by weight of the total weight of the functional fluid. Generally, the functional fluids will contain at least about 75% by weight of the synthetic base oil and more often will comprise at least 85 or 95% of the synthetic base oil. The functional fluids of the present invention preferably, are essentially free of natural oils which are not stable at the higher temperatures. In some embodiments some natural oils such as mineral oils can be tolerated, but the functional fluids of the present invention should contain less than 5% by weight of the natural oils, and more preferably less than 1%.

In addition to the functional fluids comprising a major amount of the synthetic base oil, the invention also relates to additive concentrates comprising the synthetic base oil and one or more of the additive components (B), (C) and (D) as identified herein. Additive concentrates will contain larger amounts of the desired additives than the functional fluids, and the concentrates may comprise from about 10% to about 90% by weight of the additive components and from about 10% to 90% by weight of the synthetic oil which may subsequently be added to additional base oil to form the desired functional fluid.

The functional fluids and concentrates of the present invention may be prepared from mixtures of two or more of the above-described synthetic oils. For example, the base oil used to prepare functional fluids may comprise from about 10 to 90 parts of one base oil such as a polyol ester and 10 to 90 parts of a second base oil such as a silicone fluid. Other useful weight ratios may be from 20:80 to 50:50.

(B) The Phenolic Compounds.

The functional fluids of the present invention may contain one or more of several types of phenolic compounds which may be metal-free phenolic compounds or neutral or basic metal salts of certain phenolic compounds. The phenolic compounds are incorporated into the functional fluids of the present invention to improve the high temperature stability of the functional fluids, and in some instances, to provide detergent properties to the functional fluids. The amount of phenolic compound incorporated into the functional fluid may vary over a wide range depending upon the particular utility for which the phenolic compound is added. In general, from about 0.1 to about 10 or 20% by weight of the phenolic compound will be included in the functional fluid. More often, the amount is from about 0.1 to about 10% by weight. Mixture of the several types of phenols can be used.

In the present specification and claims, the terms "ashless", "metal-free", "neutral", and "basic" are to be given their normal meanings. The term "metal-free" indicates that the material is substantially free of any metal and, for example, with respect to the phenolic compounds, contains a free hydroxyl group(s). The term "ashless" is intended to have the same meaning as metal-free. The term "neutral metal salt" is used to refer to the phenolic material (acidic) that has been reacted with an amount of a base sufficient to neutralize the acidic groups present in the phenolic compound. The term "basic" is used to refer to acidic compositions which have been reacted with a stoichiometric excess of a base such as a metal base to form a material containing an excess of the metal over that required to neutralize the acidic material.

Hindered phenols are defined in the specification and claims as those containing a sterically hindered hydroxyl group, and these include those derivatives of dihydroxy aryl compounds wherein the hydroxyl groups are in the o- or p-position to each other.

(B-1) Metal-Free Hindered Phenols Substituted with an Alkyl Group Containing at Least about 6 Carbon Atoms.

In one embodiment, the functional fluids of the present invention contain at least one metal-free hindered phenol substituted with at least one alkyl group containing at least about 6 carbon atoms. Alkylene coupled derivatives of said hindered phenols also can be used in the functional fluids of the invention.

The metal-free hindered phenols substituted with at least one alkyl group containing at least about 6 carbon atoms can be represented by the following Formulae VIII, IX and X.

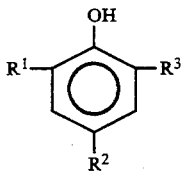

(VIII)

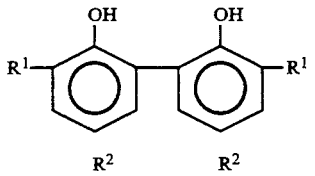

(IX)

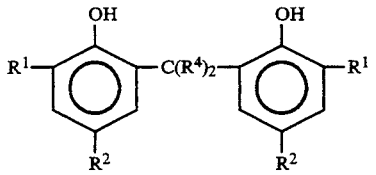

(X)

wherein each $R^1$ is independently an alkyl group containing from 3 to about 9 carbon atoms, each $R^2$ is an alkyl group containing at least about 6 carbon atoms, $R^3$ is hydrogen or an alkyl group containing from 1 to about 9 carbon atoms, and each $R^4$ is independently hydrogen or a methyl group. In the preferred embodiment, $R^2$ is an alkyl group containing from 6 to about 20, more preferably from about 6 to about 12 carbon atoms. Examples of such groups include hexyl, heptyl, octyl, decyl, dodecyl, tripropenyl, tetrapropenyl, etc. Examples of $R^1$ and $R^2$ groups include propyl, isopropyl, butyl, secondary butyl, tertiary butyl, heptyl, octyl, and nonyl. Preferably, each $R^1$ is a tertiary group such as tertiary butyl, tertiary amyl, etc. The phenolic compounds of the type represented by Formula VIII may be prepared by various techniques, and in one embodiment, such phenols are prepared in stepwise manner by first preparing the para-substituted alkyl phenol, and thereafter alkylating the para-substituted phenol in the 2- and/or 6-position as desired. When it is desired to prepare coupled phenols of the type represented by Formulae IX and X, the second step alkylation is conducted under conditions which result in the alkylation of only one of the positions ortho to the hydroxyl group. Examples of useful phenolic materials of the type represented by Formula VIII include: 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-di-t-butyl-4-heptyl phenol; and 2-methyl-6-di-t-butyl-4-dodecyl phenol.

Examples of the ortho coupled phenols of the type represented by Formula IX include: 2,2'-bis(6-t-butyl-4-heptyl phenol); 2,2'-bis(6-t-butyl-4-octyl phenol); and 2,2'-bis(6-t-butyl-4-dodecyl phenol).

Alkylene-coupled phenolic compounds of the type represented by Formula X can be prepared from the phenols represented by Formula VIII wherein $R^3$ is hydrogen by reaction of the phenolic compound with an aldehyde such as formaldehyde, acetaldehyde, etc. or a ketone such as acetone. Procedures for coupling of phenolic compounds with aldehydes and ketones are well known in the art, and the procedures do not need to be described in detail herein. To illustrate the process, the phenolic compound of the type represented by Formula VIII wherein $R^3$ is hydrogen is heated with a base in a diluent such as toluene or xylene, and this mixture is then contacted with the aldehyde or ketone while heating the mixture to reflux and removing water as the reaction progresses. Examples of phenolic compounds of the type represented by Formula X include 2,2'-methylene-bis(6-t-butyl-4-heptyl phenol); 2,2'-methylene-bis(6-t-butyl-4-octyl phenol); and 2,2'-methylene-bis(6-t-butyl-4-dodecyl phenol).

The following examples illustrate the preparation of phenolic compounds of the type represented by Formulae VIII and X. In the following examples, and elsewhere in the specification and claims, all percentages and parts are by weight, temperatures are in degrees Celsius, and pressure is at or near atmospheric unless clearly indicated otherwise.

EXAMPLE B-1

The reactor is charged with 4770 parts of 4-heptyl phenol which is then heated to about 40° C. where upon 290 parts of an acidified clay are added as catalysts. This mixture is heated to 105°–110° C. to remove any water present. After cooling to about 95° C., isobutylene is bubbled through the mixture at a rate of about 6.5 cfh for 5 hours. The mixture is then blown with nitrogen for 2 hours at 100° C., and after cooling to room temperature is filtered through a filter aid. The filtrate is the desired 2-t-butyl-4-tetrapropenyl phenol.

EXAMPLE B-2

A reactor is charged with 2556 parts of the phenol prepared in B-1 and 1250 parts of xylene. The contents of the reactor are heated to 40° C. and the reactor is charged with 72 grams of 50% aqueous sodium hydroxide. Aqueous formaldehyde (364 grams of 30% formaldehyde) is added dropwise over a period of one hour as the reaction temperature varies from 40°–60° C. Upon completion of the addition of the formaldehyde, the contents of the reactor are heated to reflux and maintained at this temperature for 3.5 hours. Water is removed as a xylene azeotrope with nitrogen blowing to 150° C. for 2 hours. After vacuum stripping the contents of the reactor to 150° C./20 mm. Hg., the mixture is cooled to 90° C., the vacuum is released, and the contents filtered. The filtrate is the desired methylene-coupled phenol which contains, by analysis (Grignard) 5.12% hydroxyl.

EXAMPLE B-3

The general procedure of Example B-1 is repeated except that the tri-propylene phenol is replaced by an equivalent amount of 4-heptyl phenol. The substituted phenol obtained in this manner contains 5.94% hydroxyl.

EXAMPLE B-4

The general procedure of Example B-2 is repeated except that the phenol of Example B-1 is replaced by the phenol of Example B-3. The methylene coupled phenol prepared in this manner contains 5.74% hydroxyl.

(B-2) Neutral and Basic Alkaline Earth Metal Salts of Hindered Phenols Which Are Not Alkylene- or Sulfur-Coupled.

The functional fluids of the present invention may contain one or more neutral or basic alkaline earth metal salts of hindered phenols. The hindered phenols from which the salt may be prepared include these (B-1) type hindered phenols discussed above and other hindered phenols well known in the art.

The following are examples of hindered phenols which may be utilized in this invention in the form of their alkaline earth metal salts:

2,4-dimethyl-6-t-butyl phenol
2,6-di-t-butyl-4-ethyl phenol
4-t-butyl catechol
2,4-di-t-butyl-p-cresol
2,6-di-t-butyl-4-methyl phenol
2-t-butyl-4-heptyl phenol
2-t-butyl-4-octyl phenol
2-t-butyl-4-dodecyl phenol, and
2,6-bis-(1′-methylcyclohexyl)-4-methyl phenol The salts may be prepared from the alkaline earth metals including the calcium, barium, magnesium, strontium, etc. salts, although calcium and barium are preferred. The neutral salts can be prepared by reacting the hindered phenol with one equivalent or a slight excess of an alkaline earth metal base such as calcium hydroxide, barium hydroxide, etc.

A commonly employed method for preparing the basic (or overbased) salts of these phenols comprises heating the phenol with a stoichiometric excess of a metal neutralizing agent such as a metal oxide, hydroxide, carbonate, bicarbonate, sulfide, etc., at temperature above about 50° C. Various promoters may be used in the overbased process to aid in the incorporation of the large excess metal. Promoters include such compounds as phenolic substances including phenol; alcohols such as methanol, 2-propanol, octyl alcohol, etc.; amines such as aniline and dodecyl amine, etc. Preferably, the basic salt is treated with carbon dioxide after it has been formed. The techniques of overbasing various phenols are described in the prior art and can be utilized as processes for preparing the basic or overbased hindered phenols used in the present invention. When following prior art techniques, however, any mineral oil or other natural oil diluent used in the prior art procedure is replaced by a synthetic oil such as a liquid polyolefin. The basic phenols have metal ratios greater than 1 to about 30 or 40.

(B-3) Metal-Free Alkyl Phenol Sulfides, and Neutral and Basic Alkaline Earth Metal Salts of Alkyl Phenol Sulfides.

In another embodiment, the functional fluids of the present invention may contain a metal-free (or ashless) alkyl phenol sulfide, a neutral or basic alkaline earth metal salt of an alkyl phenol sulfide, or mixtures thereof. The neutral and basic salts of the phenol sulfides are detergents and antioxidants in the functional fluid compositions of the invention. As will be described more fully below, when the phenolic compound is metal-free or ashless, it is often desirable to include an ash-containing detergent in the functional fluid.

The alkylphenols from which the sulfides are prepared may comprise phenols containing hydrocarbon substituents with at least about 6 carbon atoms, and the substituents may contain up to about 700 aliphatic carbon atoms or more. Also included are substantially hydrocarbon substituents, that is, substituents which are primary hydrocarbon in nature but contain a small amount of non-hydrocarbon groups such as halogen, hydroxy, carboxy, mercapto, nitro, amino, nitroso, etc. The preferred hydrocarbon substituents are derived from the polymerization of olefins such as ethylene, propene, 1-butene, isobutene, 1-hexene, 1-octene, 2-methyl-1-heptene, 2-butene, 2-pentene, 3-pentene and 4-octene. The hydrocarbon substituent may be introduced onto the phenol by mixing the hydrocarbon and the phenol at a temperature of about 50°–200° C. in the presence of a suitable catalyst such as aluminum trichloride, boron trifluoride, zinc chloride or the like. The substituent can also be introduced by other alkylation processes known in the art.

The alkyl phenols from which the sulfides are prepared also may comprise phenols of the type discussed above and represented by Formula VIII wherein $R^3$ is hydrogen. For example, the alkyl phenols which can be converted to alkyl phenol sulfides include: 2-t-butyl-4-heptyl phenol; 2-t-butyl-4-octyl phenol; and 2-t-butyl-4-dodecyl phenol.

The term "alkylphenol sulfides" is meant to include di-(alkylphenol)monosulfides, disulfides, polysulfides, and other products obtained by the reaction of the alkylphenol with sulfur monochloride, sulfur dichloride or elemental sulfur. The molar ratio of the phenol to the sulfur compound can be from about 1:0.5 to about 1:1.5, or higher. For example, the alkyl phenol sulfides are readily obtained by mixing, at a temperature above about 60° C., one mole of an alkylphenol and 0.5–1.5 moles of sulfur dichloride. The reaction mixture is usually maintained at about 100° C. for about 2–5 hours, after which time the resulting sulfide is dried and filtered. When elemental sulfur is used, temperatures of about 200° C. or higher are sometimes desirable. It is also desirable that the drying operation be conducted under nitrogen or a similar inert gas.

A commonly employed method for preparing the basic (or overbased) salts of the phenol sulfides comprises heating the alkyl phenol sulfide with a stoichiometric excess of a metal neutralizing agent such as a metal oxide, hydroxide, carbonate, bicarbonate, sulfide, etc. at temperatures above about 50° C. In addition, various promoters may be used in the overbasing process to aid in the incorporation of the large excess of metal. These promoters include such compounds as phenolic substances including phenol, naphthol, alkyl naphthol; alcohols such as methanol, 2-propanol, octyl alcohol, Cellosolve carbitol, ethylene glycol, stearyl alcohol and cyclohexyl alcohol; amines such as aniline and dodecylamine, etc. Preferably, the basic salt is treated with carbon dioxide after it has been formed.

It is often preferred to use, as an additional promoter, a carboxylic acid containing about 1-100 carbon atoms or an alkali metal, alkaline earth metal, zinc or lead salt thereof. Especially preferred in this regard are the lower alkyl monocarboxylic acids including formic acid, acetic acid, propionic acid, butyric acid, isobutyric acid and the like. The amount of such acid or salt used is generally about 0.002-0.2 equivalent per equivalent of metal base used for formation of the basic salt.

In an alternative method for preparation of these basic salts, the alkylphenol is reacted simultaneously with sulfur and the metal base. The reaction should then be carried out at a temperature of at least about 150° C., preferably about 150°-200° C. It is frequently convenient to use as a solvent a compound which boils in this range, preferably a mono-(lower alkyl) ether of a polyethylene glycol such as diethylene glycol. The methyl and ethyl ethers of diethylene glycol, which are respectively sold under the trade names "Methyl Carbitol" and "Carbitol", are especially useful for this purpose.

Suitable basic alkyl phenol sulfides are disclosed, for example, in U.S. Pat. Nos. 3,372,116, 3,410,798 and 4,021,419, which are hereby incorporated by reference.

These sulfur-containing phenolic compositions described in U.S. Pat. No. 4,021,419 are obtained by sulfurizing a substituted phenol with sulfur or a sulfur halide and thereafter reacting the sulfurized phenol with formaldehyde or a reversible polymer thereof. Alternatively the substituted phenol can be first reacted with formaldehyde and thereafter reacted with sulfur or a sulfur halide to produce the desired alkyl phenol sulfide. The resulting sulfurized polyphenols can be reacted with metal bases, especially alkali metal and alkaline earth metal bases, to yield basic salts of the phenolic compounds. The disclosure of U.S. Pat. No. 4,021,419 is hereby incorporated by reference for its disclosure of such compounds and salts, and methods for preparing such compounds and salts. A synthetic oil of the type described above is used in place of any mineral or natural oils used in the preparation of the salts for use in this invention.

The following examples illustrate methods for the preparation of ashless as well as ash-containing alkyl phenol sulfides.

EXAMPLE B-5

A phenol sulfide is prepared by adding one mole of sulfur dichloride to 2 moles of tetrapropene-substituted phenol at 100°-105° C. over 2 hours. The mixture is heated an additional hour and blown with nitrogen.

EXAMPLE B-6

A phenol sulfide is prepared by reacting sulfur dichloride with a polyisobutenyl phenol in which the polyisobutenyl substituent has a number average molecular weight of about 350, in the presence of sodium acetate (an acid acceptor used to avoid discoloration of the product).

EXAMPLE B-7

A mixture of 1755 parts of the phenol sulfide of Example B-6, 500 parts of a liquid hydrogenated polyolefin diluent, 335 parts of calcium hydroxide and 407 parts of methanol is heated to about 43°-50° C. and carbon dioxide is bubbled through the mixture for about 7.5 hours. The mixture is then heated to drive off volatile matter, and an additional 422.5 parts of polyolefin diluent are added to provide a 60% solution in diluent. This Solution contains 5.6% calcium and 1.59% sulfur.

EXAMPLE B-8

To 6072 parts (22 equivalents) of a tetrapropylene-substituted phenol (prepared by mixing, at 138° C. and in the presence of a sulfuric acid treated clay, phenol and tetrapropylene), there are added at 90°-95° C., 1134 parts (22 equivalents) of sulfur dichloride. The addition is made over a 4-hour period whereupon the mixture is bubbled with nitrogen for 2 hours, heated to 150° C. and filtered. To 861 parts (3 equivalents) of the above product, 1068 parts of a liquid synthetic oil diluent, and 90 parts of water, there are added at 70° C., 122 parts (3.3 equivalents) of calcium hydroxide. The mixture is maintained at 110° C. for 2 hours, heated to 165° C. and maintained at this temperature until it is dry. Thereupon, the mixture is cooled to 25° C. and 180 parts of methanol are added. The mixture is heated to 50° C. and 366 parts (9.9 equivalents) of calcium hydroxide and 50 parts (0.633 equivalent) of calcium acetate are added. The mixture is agitated for 45 minutes and is then treated at 50°-70° C. with carbon dioxide at a rate of 2-5 cubic feet per hour for 3 hours. The mixture is dried at 165° C. and the residue is filtered. The filtrate has a calcium content of 8.8%, a neutralization number of 39 (basic) and a metal ratio of 4.4.

EXAMPLE B-9

To 5880 parts (12 equivalents) of a polyisobutene-substituted phenol (prepared by mixing, at 54° C. and in the presence of boron trifluoride, equimolar amounts of phenol and a polyisobutene having a number average molecular weight of about 350) and 2186 parts of mineral oil, there are added over 2.5 hours and at 90°-110° C., 618 parts (12 equivalents) of sulfur dichloride. The mixture is heated to 150° C. and bubbled with nitrogen. To 3449 parts (5.25 equivalents) of the above product, 1200 parts of a polyolefin diluent, and 130 parts of water, there are added at 70° C., 147 parts (5.25 equivalents) of calcium oxide. The mixture is maintained at 95°-110° C. for 2 hours, heated to and maintained at 160° C. for one hour and then cooled to 60° C. whereupon 920 parts of 1-propanol, 307 parts (10.95 equivalents) of calcium oxide, and 46.3 parts (0.78 equivalent) of acetic acid are added. The mixture is then contacted with carbon dioxide at a rate of 2 cubic feet per hour for 2.5 hours. The mixture is dried at 190° C. and the residue is filtered to give the desired product.

EXAMPLE B-10

A mixture of 485 parts (1 equivalent) of a polyisobutene-substituted phenol wherein the substituent has a number average molecular weight of about 400, 32 parts (1 equivalent) of sulfur, 111 parts (3 equivalents) of calcium hydroxide, 16 parts (0.2 equivalent) of calcium acetate, 485 parts of diethylene glycol monomethyl ether and 414 parts of a polyolefin diluent is heated at 120°-205° C. under nitrogen for 4 hours. Hydrogen sulfide evolution begins as the temperature rises above 125° C. The material is allowed to distil and hydrogen sulfide is absorbed in a sodium hydroxide solution. Heating is discontinued when no further hydrogen sulfide absorption is noted; the remaining volatile material is removed by distillation at 95° C./10 mm pressure. The distillation residue is filtered. The product thus obtained is a 60% solution of the desired product in the diluent.

EXAMPLE B-11

To a solution of 1590 parts (10 equivalents) of the sulfurized phenol prepared in B-5 in 1590 parts of a synthetic oil are added, at 50° C., 225 parts (15 equivalents) of paraformaldehyde and 75 parts of commercial aqueous ammonia. The mixture is heated for 3 hours at 95° C., and then for 3 hours at 150°-160° C. to remove volatiles. A filter aid material is added and the product is filtered at 160° C. The filtrate is the desired product obtained as a 48.5% solution in oil and it contains 2.7% phenolic hydroxyl.

EXAMPLE B-12

A polyisobutene-substituted phenol wherein the polyisobutene substituent has a molecular weight of about 300 (2450 parts, 5 equivalents) is heated to 60° C. and 75 parts (5 equivalents) of paraformaldehyde and 50 parts of commercial aqueous ammonia are added. The mixture is stirred for 5 hours at 85°-100° C. and is then heated to 160° C. to remove volatiles. It is cooled to 75° C. and 258 parts (10 equivalents) of sulfur dichloride is added dropwise at 75°-110° C. After hydrogen chloride evolution has ceased, the mixture is blown with nitrogen at 150° C. for several hours, after which a filter aid is added and the mixture is filtered. A synthetic oil (liquid hydrogenated polyolefin) is added to provide a 75% solution of the desired product in the oil; this solution contains 1.87% sulfur and 2.07% phenolic hydroxyl.

EXAMPLE B-13

A reactor is charged with 497 parts (1.5 moles) of a 4-tetrapropenyl-6-t-butyl phenol similar to the phenol prepared in Example B-3 but containing 5.13% hydroxyl, and 78 parts (0.75 mole) of sulfur chloride is added at 50°-60° C. over one hour. The mixture is then maintained at 60°-65° C. for 1.5 hours, and heated gradually to 145° C. The reaction mixture is blown with nitrogen for 2 hours at 140°-145° C., and the residue is recovered as the desired sulfur-coupled phenol containing 4.96% sulfur (theory 4.65).

(B-4) Neutral and Basic Alkaline Earth Metal Salts of Alkylene-Coupled Phenols.

The alkylene-coupled phenols may be obtained by reacting a phenol (2 equivalents) with 1 equivalent of an aldehyde or ketone. Lower molecular weight aldehydes are preferred and particularly preferred examples of useful aldehydes include formaldehyde, a reversible polymer thereof such as paraformaldehyde, trioxane, acetaldehyde, etc. As used in this specification and claims, the word "formaldehyde" shall be deemed to include such reversible polymers. The alkylene-coupled phenols can be derived from phenol or substituted alkyl phenols, and substitued alkyl phenols are preferred. The phenol must have an ortho or para position available for reaction with the aldehyde.

In one embodiment, the phenol will contain one or more alkyl groups which may or may not result in a sterically hindered hydroxyl group. For example, the alkylene-coupled phenol may be prepared from alkyl phenols of the type described above with respect to component (B-1) and these are hindered phenols. Some of the alkyl phenols described with respect to component (B-3), are not generally considered to be hindered phenols. Examples of hindered phenols which can be used in the formation of the alkylene-coupled phenols include: 2,4-dimethylphenol; 2,4-di-t-butyl phenol, 2,6-di-t-butyl phenol; 4-octyl-6-t-butyl phenol; etc.

In one preferred embodiment, the phenol from which the alkylene-coupled phenols are prepared are phenols substituted in the para position with aliphatic groups containing at least 6 carbon atoms such as described above with respect to the alkyl phenols used in the preparation of component (B-3). Generally, the alkyl groups contain from 6 to 12 carbon atoms. Preferred alkyl groups are derived from polymers of ethylene, propylene, 1-butene and isobutene.

The reaction between the phenol and the aldehyde, polymer thereof or ketone is usually carried out between room temperature and about 150° C., preferably about 50°-125° C. The reaction preferably is carried out in the presence of an acidic or basic material such as hydrochloric acid, acetic acid, ammonium hydroxide, sodium hydroxide or potassium hydroxide. The relative amounts of the reagents used are not critical, but it is generally convenient to use about 0.3 to about 2.0 moles of phenol per equivalent of formaldehyde or other aldehyde.

Specific examples of alkylene-coupled phenols which can be utilized to form the neutral and basic alkaline earth metal salts to be utilized in the functional fluids of the present invention include: 2,2'-methylene-bis-(4,6-di-t-butyl phenol); 4,4'-methylene-bis-(2,6-di-t-butyl phenol); 2,2'-methylene-bis-4-chloro-6-t-butyl phenol; 2,2'-methylene-bis-(4-heptyl-6-t-butyl phenol); 2,2'-methylene-bis-(4-dodecyl-6-t-butyl phenol); 2,2'-methylene-bis-(4-octyl-6-t-butyl phenol); 2,2'-methylene-bis-(4-octyl phenol); 2,2'-methylene-bis-(4-dodecyl phenol); 2,2'-methylene-bis-(4-heptyl phenol).

The neutral and basic alkylene earth metal salts of the above-described alkylene-coupled phenols can be prepared by techniques well known in the art such as those described above for preparing neutral and basic alkaline earth metal salts of the other phenols described above. Any of the alkaline earth metals can be utilized, and calcium, magnesium and barium are preferred. When basic metal salts are prepared, the basic salts will be characterized as having a metal ratio of at least about 2 and as high as 20 or 40.

(C) Non-Phenolic Oxidation Inhibitors.

The functional fluids of the present invention also contain at least one non-phenolic oxidation inhibitor. Suitable examples of non-phenolic antioxidants which can be utilized include: alkylated and non-alkylated aromatic amines and mixtures thereof; alkyl, aryl or alkaryl phosphites such as triphenyl phosphites, trinonyl phosphite and diphenyl decyl phosphites; esters of thiodipropionic acid such as dilaurylthiodipropionate; salts of carbamic and dithiophosphoric acids such as antimony diamyldithiocarbamate and zinc diamyldithiocarbamate; metal salts or complexes of organic chelating agents such as copper bis (trifluoroacetylacetonates), copper phthalocyanines, etc.; and free radical antioxidants and their precursors such as amine oxides and nitroxides.

In one preferred embodiment, the non-phenolic oxidation inhibitor is an aromatic amine. Useful aromatic amines include aromatic monoamines characterized by the formula $$R^3R^4R^5N \quad \text{(III)}$$

wherein $R^3$ is an aliphatic, aromatic or substituted aromatic group, $R^4$ is an aromatic or a substituted aromatic group, and $R^5$ is H, alkyl, aryl or $$-R^6S(O)_xR^7$$

where $R^6$ is an alkylene, alkenylene, or aralkylene group or mixture thereof, $R^7$ is a higher alkyl group, or an alkenyl, aryl, or alkaryl group or mixtures thereof, and x is 0, 1 or 2. The aliphatic group $R^3$ may contain from I to about 20 carbon atoms, and preferably contains from 6 to 12 carbon atoms. The aliphatic group is a saturated aliphatic group. Preferably, both $R^3$ and $R^4$ are aromatic or substituted aromatic groups, and the aromatic group may be a fused ring aromatic group such as naphthyl. Aromatic groups $R^3$ and $R^4$ may be joined together with other groups such as S.

In one particular embodiment, the aromatic amines useful as antioxidant (C) may be represented by the formulae

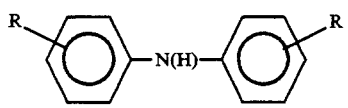

(IV)

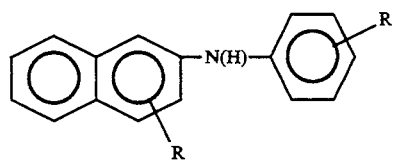

(V)

wherein each R is independently hydrogen or an aliphatic group containing at least 6 carbon atoms. Examples of aliphatic groups include hexyl, heptyl, octyl, nonyl, decyl, etc. Generally, the aliphatic groups will not contain more than 14 carbon atoms. The general types of amine antioxidants useful in the present invention include diphenylamines, phenyl naphthylamines, phenothiazines, imidodibenzyls and diphenyl phenylene diamines. Mixtures of two or more aromatic amines are also useful. Polymeric amine antioxidants can also be used in this invention. An example of a commercially available polymeric aromatic amine antioxidant is Ultranox 254 from Borg Warner.

Particular examples of such aromatic amine antioxidants useful in the present invention include: p,p'-dioctyldiphenylamine; octylphenyl-beta-naphthylamine; octylphenyl-alpha-naphthylamine; phenyl-alphanaphthylamine; phenyl-beta-naphthylamine; p-octyl phenyl-alpha-naphthylamine; 4-octylphenyl-l-octyl-beta-naphthylamine.

In another embodiment, the amine antioxidant may be phenothiazine, substituted phenothiazines, or derivatives such as represented by Formula VIII

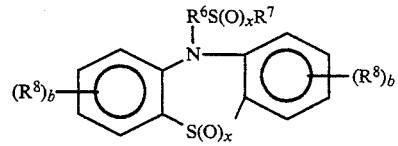

(VIII)

wherein $R^7$ is selected from the group consisting of higher alkyl groups, or an alkenyl, aryl, alkaryl or aralkyl group and mixtures thereof; $R^6$ is an alkylene, alkenylene or an aralkylene group, or mixtures thereof; each $R^8$ is independently alkyl, alkenyl, aryl, alkaryl, arylalkyl, halogen, hydroxyl, alkoxy, alkylthio, arylthio, or fused aromatic rings, or mixtures thereof; a and b are each independently 0 or greater; and x is 0, 1 or 2.

In another embodiment, the phenothiazine derivatives may be represented by Formula VIIIA

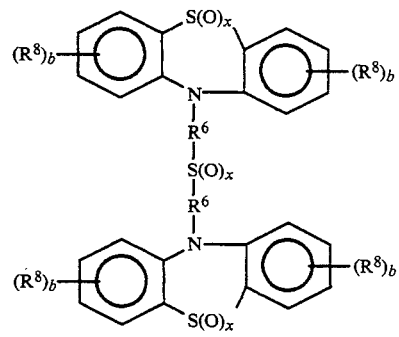

(VIIIA)

wherein $R^6$, $R^7$, $R^8$, a, b and x are as defined with respect to Formula VIII.

The above-described phenothiazine derivatives, and methods for their preparation are described in U.S. Pat. No. 4,785,095, and the disclosure of this patent is hereby incorporated by reference for its teachings of such methods and compounds. In one embodiment, a dialkyldiphenylamine is treated with sulfur at an elevated temperature such as in the range of 145° C. to 205° C. for a sufficient time to complete the reaction. A catalyst such as iodine may be utilized to establish the sulfur bridge.

Phenothiazine and its various derivatives can be converted to compounds of Formula VIII by contacting the phenothiazine compound containing the free NH group with a thio alcohol of the formula $R^7SR^6OH$ where $R^7$ and $R^6$ are defined with respect to Formula VIII. The thio alcohol may be obtained by the reaction of a mercaptan $R^7SH$ with an alkylene oxide under basic conditions. Alternatively, the thio alcohol may be obtained by reacting a terminal olefin with mercapto ethanol under free radical conditions. The reaction between the thio alcohol and the phenothiazine compound generally is conducted in the presence of an inert solvent such as toluene, benzene, etc. A strong acid catalyst such as sulfuric acid or para-toluene sulfonic acid at about 1 part to about 50 parts of catalyst per 1000 parts of phenothiazine is preferred. The reaction is conducted generally at reflux temperature with removal of water as it is formed. Conveniently, the reaction temperature may be maintained between 80° C. and 170° C.

When it is desired to prepare compounds of the type represented by Formulae VIII and VIIIA wherein x is 1 or 2, i.e., sulfones or sulfoxides, the derivatives prepared by the reaction with the thio alcohols described above are oxidized with an oxidizing agent such as hydrogen peroxide in a solvent such as glacial acetic acid or ethanol under an inert gas blanket. The partial oxidation takes place conveniently at from about 20° C. to about 150° C. The following examples illustrate the preparation of phenothiazines which may be utilized as the non-phenolic antioxidant (C) in the functional fluids of the present invention.

EXAMPLE C-1

One mole of phenothiazine is placed in a one-liter, round bottom flask with 300 ml. of toluene. A nitrogen blanket is maintained in the reactor. To the mixture of phenothiazine and toluene is added 0.05 mole of sulfuric acid catalyst. The mixture is then heated to reflux temperature and 1.1 moles of n-dodecylthioethanol is added dropwise over a period of approximately 90 minutes. Water is continuously removed as it is formed in the reaction process.

The reaction mixture is continuously stirred under reflux until substantially no further water is evolved. The reaction mixture is then allowed to cool to 90° C. The sulfuric acid catalyst is neutralized with sodium hydroxide. The solvent is then removed under a vacuum of 2 KPa at 110° C. The residue is filtered giving a 95% yield of the desired product.

EXAMPLE C-2

One mole of phenothiazine is placed in a one-liter, round bottom flask with 300 ml. of toluene. The reactants and maintained under a nitrogen blanket. To the mixture of the phenothiazine and toluene is added 0.05 mole of sulfuric acid as a catalyst. The mixture is then heated to reflux temperatuare and 1.1 moles of n-hexylthioethanol are added dropwise over a period of approximately 90 minutes. Water is continuously removed as it is formed in the reaction process.

The reaction mixture is continuously stirred under reflux until substantially no more water is evolved. The reaction mixture is then allowed to cool to 90° C. The sulfuric acid catalyst is neutralized with sodium hydroxide. The solvent is then removed under a vacuum of 2 KPa at 110° C. The residue is filtered giving the desired product.

EXAMPLE C-3

Phenothiazine is alkylated with nonene, using aluminum chloride as a Friedel Crafts catalyst under conventional conditions. One mole of the dialkylated phenothiazine is placed in a one liter round bottom flask with 300 milliliters of toluene. A nitrogen sparge and blanket are employed. To the mixture of the dialkylated phenothiazine and toluene is added 0.05 mole of sulfuric acid as a catalyst. The mixture is then heated to reflux and 1.1 moles of n-dodecylthioethanol is added dropwise over a period of approximately 90 minutes. Water is continuously removed as it is formed.

The reaction mixture is continually stirred under reflux until substantially no further water is obtained. The reaction mixture is then allowed to cool to 90°+ C. The sulfuric acid catalyst is neutralized with sodium hydroxide. The solvent is then removed under a vacuum of 2 KPa at 110° C. The residue is then filtered giving a 95% yield of the desired product.

EXAMPLE C-4

One mole of phenyl alpha-naphthylamine is placed in a one-liter round bottom flask under a nitrogen blanket. The amine is first sulfurized at 190° C. with an iodine catalyst under conventional conditions. Then, 1.1 moles of n-stearyl thioethanol is utilized to alkylate the sulfurized product in 300 ml. toluene using a small amount of sulfuric acid catalyst. The reaction is allowed to proceed over a period of 90 minutes. Water is continuously removed as it is formed in the reaction process. The reaction mixture is continually stirred at reflux until substantially no more water is evolved. The reaction mixture is then allowed to cool to 90° C. The sulfuric acid catalyst is then neutralized with sodium hydroxide. The solvent is then removed under a vacuum of 2 KPa at 110° C. to give the benzophenothiazine product.

EXAMPLE C-5

One mole of aphenothiazine is placed in a one-liter round bottom flask with 300 ml of toluene under a nitrogen blanket. To the mixture of the phenothiazine and toluene is added 0.05 mole of sulfuric acid as a catalyst. The mixture is then heated to reflux temperature and 1.1 moles of phenylthioethanol is added dropwise over a period of approximatley 90 minutes. The phenylthioethanol is obtained from the reaction of thiophenol and ethylene oxide with a basic catalyst. Water is continuously removed as it is formed in the reaction process.

The reaction mixture is continuously stirred under reflux under substantially no further water is evolved. The reaction mixture is then allowed to cool to 90° C. The sulfuric acid catlayst is neutralized with sodium hydroxide. The solvent is then removed under a vacuum of 2 KPa at 110° C. The residue is filtered giving the desired product.

EXAMPLE C-6

Two moles of the dialkylated phenothiazine of Example C-3 are placed in a two-liter, round bottom blask with 600 ml. of toluene under a nitrogen blanket. To the mixture of the alkylated phenothiazine derivative and toluene is added 0.1 mole of sulfuric acid as a catalyst. The mixture is then heated to reflux temperature and 1.1 moles of thiodiethanol is added dropwise over a period of approximately 90 minutes. Water is continuously removed as it is formed in the reaction process.

The reaction mixture is continuously stirred under reflux until substantially no more water is evolved. The reaction mixture is then allowed to cool to 90° C. The sulfuric acid catalyst is neutralized with sodium hydroxide. The solvent is then removed under a vacuum of 2 KPa at 110° C. The residue is filtered to yield the desired product which is a symmetrical bisphenothiazine derivative.

EXAMPLE C-7

The product of Example C-1 is oxidized as follows. In a reactor there is placed 0.2 mole of the product of Example C-1 and 400 ml. of ethanol. A blanket of nitrogen is maintained throughout the reaction. The mixture is then heated to reflux, and 30% hydrogen peroxide (0.2 mole) is added dropwise over a period of 30 minutes followed by stirring under reflux for 5 hours. The reaction mixture is cooled, and water in the amount of 400 ml. is mixed with the product. The lower organic layer is separated, dried with magnesium sulfate, and recovered. Residual solvent is removed leaving the desired oxidized product.

The amount of non-phenolic antioxidant (C) included in the functional fluids of the present invention may vary over a wide range such as from about 0.01 to about 10 or 20% by weight. Generally, the amount of the non-phenolic antioxidant such as the referred aromatic secondary amines, is from about 0.01 to about 5% by weight.

(D) The Basic Alkali or Alkaline Earth Metal Salt of a Sulfonic or Carboxylic Acid.

When the phenolic compound (B) included in the functional fluids of the present invention is a metal-free phenolic compound or a neutral metal salt, it is often desirable to include at least one alkali metal or alkaline earth metal salt of a sulfonic or carboxylic acid, or mixtures thereof, in the functional fluid. Such basic salt compounds generally are referred to as ash-containing detergents.

Of the alkali metals, sodium and potassium are preferred, and of the alkaline earth metals, calcium, magnesium, barium and strontium are preferred. Salts containing a mixture of ions of two or more of the alkali and alkaline earth metals can be used. The basic metal salts will have metal ratios of from about 2 to about 30 or 40.

The sulfonic acids which are useful in preparing component (D) include those represented by the formulae $$R_xT(SO_3H)_y \quad \text{(VI)}$$

and $$R'(SO_3H)_r \quad \text{(VII)}$$

In these formulae, R' is an aliphatic or aliphatic-substituted cycloaliphatic hydrocarbon or essentially hydrocarbon group free from acetylenic unsaturation and containing up to about 60 carbon atoms. When R' is aliphatic, it usually contains at least about 15 carbon atoms; when it is an aliphatic-substituted cycloaliphatic group, the aliphatic substituents usually contain a total of at least about 12 carbon atoms. Examples of R' are alkyl, alkenyl and alkoxyalkyl radicals, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of R' are cetylcyclohexyl, laurylcyclohexyl, cetyloxyethyl, octadecenyl, and groups derived from petroleum, saturated and unsaturated paraffin wax, and olefin polymers including polymerized monoolefins and diolefins containing about 2–8 carbon atoms per olefinic monomer unit. R' can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

R in Formula VI is generally a hydrocarbon or essentially hydrocarbon group free from acetylenic unsaturation and containing from about 4 to about 60 aliphatic carbon atoms, preferably an aliphatic hydrocarbon group such as alkyl or alkenyl. It may also, however, contain substituents or interrupting groups such as those enumerated above provided the essentially hydrocarbon character thereof is retained. In general, any non-carbon atoms present in R' or R do not account for more than 10% of the total weight thereof.

T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–2 per molecule and are generally 1.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing the salts (D). It is to be understood that such examples serve also to illustrate the salts of such sulfonic acids useful as component (D). In other words, for every sulfonic acid enumerated, it is intended that the corresponding basic alkali and alkaline earth metal salts thereof are also understood to be illustrated. (The same applies to the lists of other acid materials listed below.) Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono-and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, New York (1969).

Other descriptions of basic sulfonate salts which can be incorporated into the functional fluids of this invention as component (D), and techniques for making them can be found in the following U.S. Pat. Nos. 2,174,110; 2,202,781; 2,239,974; 2,319,121; 2,337,552; 3,488,284; 3,595,790; and 3,798,012. These are hereby incorporated by reference for their disclosures in this regard. As indicated above, when the prior art procedures use mineral oil as a diluent, the procedure is modified to substitute a synthetic oil as a diluent since the presence of natural oils such as mineral oil is to be minimized if not eliminated in the functional fluids of this invention.

Suitable carboxylic acids from which useful alkali and alkaline earth metal salts (D) can be prepared include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids gene rally contain from about 8 to about 50, and preferably from about 12 to about 25 carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyloctahydroindenecarboxylic acid, palmitic acid, alkyl-and alkenylsuccinic acids, acids formed by oxidation of petrolatum or of hydrocarbon waxes, and commercially available mixtures of two or more carboxylic acids such as tall oil acids, rosin acids, and the like.

The equivalent weight of the acidic organic compound is its molecular weight divided by the number of acidic groups (i.e., sulfonic acid or carboxy groups) present per molecule.

Component (D) may also be at least one basic alkali metal salt of the sulfonic carboxylic acids described above. A general description of some of the alkali metal salts useful as component (D) is contained in U.S. Pat. No. 4,326,972 (Chamberlin). This patent is hereby incorporated by reference for its disclosure of useful alkali metal salts and methods of preparing said salts.

The amount of component (D) included in the functional fluids of the present invention also may be varied over a wide range, and useful amounts in any particular functional fluid can be readily determined by one skilled in the art. The amount of component (D) contained in a fluid of the invention may vary from about 0% or 0.01% to about 5% or more by weight.

The following examples illustrate the preparation of basic alkaline earth metal salts useful as component (D).

EXAMPLE D-1

A mixture of 906 parts of an oil solution of an alkyl phenyl sulfonic acid (having a number average molecular weight of 450, 564 parts of a liquid polyolefin diluent, 600 parts toluene, 98.7 parts magnesium oxide and 120 parts water is blown with carbon dioxide at a temperature of 78°-85° C. for 7 hours at a rate of about 3 cubic feet of carbon dioxide per hour. The reaction mixture is constantly agitated throughout the carbonation. After carbonation, the reaction mixture is stripped to 165° C./20 tor and the residue filtered. The filtrate is an oil solution (34% synthetic polyolefin) of the desired overbased magnesium sulfonate having a metal ratio of about 3.

EXAMPLE D-2

A polyisobutenyl succinic anhydride is prepared by reacting a chlorinated poly(isobutene) (having an average chlorine content of 4.3% and derived from a polyisobutene having a number average molecular weight of about 1150) with maleic anhydride at about 200° C. To a mixture of 1246 parts of this succinic anhydride and 1000 parts of toluene there is added at 25° C., 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration provides a filtrate containing the desired product.

EXAMPLE D-3

A basic calcium sulfonate having a metal ratio of about 15 is prepared by carbonation, in increments, of a mixture of calcium hydroxide, a neutral sodium petroleum sulfonate, calcium chloride, methanol and an alkyl phenol.

EXAMPLE D-4

A mixture of 323 parts of synthetic oil (polyolefin), 4.8 parts of water, 0.74 parts of calcium chloride, 79 parts of lime, and 128 parts of methyl alcohol is prepared, and warmed to a temperature of about 50° C. To this mixture there is added 1000 parts of an alkyl phenyl sulfonic acid having a number average molecular weight of 500 with mixing. The mixture then is blown with carbon dioxide at a temperature of about 50° C. at the rate of about 5.4 pounds per hour for about 2.5 hours. After carbonation, 102 additional parts of the diluent are added and the mixture is stripped of volatile materials at a temperature of about 150°-155° C. at 55 mm. pressure. The residue is filtered and the filtrate is the desired synthetic oil solution of the overbased calcium sulfonate having calcium content of about 3.7% and a metal ratio of about 1.7.

EXAMPLE D-5

A mixture of 490 parts (by weight) of synthetic oil (polyolefin), 110 parts of water, 61 parts of heptylphenol, 340 parts of barium mahogany sulfonate, and 227 parts of barium oxide is heated at 100° C. for 0.5 hour and then to 150° C. Carbon dioxide is then bubbled into the mixture until the mixture is substantially neutral. The mixture is filtered and the filtrate found to have a sulfate ash content of 25%.

The functional fluids of the present invention also may contain other additives in combination with the phenolic composition (B) and the antioxidant (C). Such additives include, for example, dispersants of the ash-producing or ashless type, auxiliary oxidation inhibitors, corrosion-inhibitors, friction modifiers, metal deactivators, extreme pressure additives, foam inhibitors, etc.

Ashless Dispersants.

In some embodiments the functional fluids in the present invention may contain at least one ashless dispersant. The amount of ashless dispersant used in the functional fluids of the invention ranges from 0 to about 10 or 15% by weight. Ashless dispersants are referred to as being ashless despite the fact that, depending on their constitution the dispersants may upon combustion yield a non-volatile material such as boric oxide or phosphorus pentoxide. However, the ashless dispersants do not ordinarily contain metal, and therefore do not yield a metal-containing ash upon combustion. Many types of ashless dispersants are known in the prior art, and any of these is suitable for use in the functional fluids of the present invention. The ashless dispersants which can be utilized in the functional fluids of the present invention include the following: carboxylic dispersants; amine dispersants; Mannich dispersants; polymeric dispersants; and carboxylic, amine or Mannich dispersants post-treated with such reagents as urea, thiourea, carbon disulfide, aldehydes, ketones, carboxylic acids, hydrocarbon-substituted succinic anhydrides, nitriles, epoxides, boron compounds, phosphorus compounds, etc.

The amine dispersants are reaction products of relatively high molecular weight aliphatic or alicyclic halides with amines, preferably polyalkylene polyamines. Amine dispersants are known and have been described in the prior art such as in U.S. Pat. Nos. 3,275,554; 3,438,757; 3,454,555; and 3,565,804. Mannich dispersants are reaction products of alkyl phenols in which the alkyl group contains at least about 30 carbon atoms with aldehydes (especially formaldehyde) and amines (especially polyalkylene polyamines). The materials described in the following patents are illustrative of Mannich dispersants: U.S. Pat. Nos. 3,413,347; 3,697,574; 3,725,277; 3,725,480; 3,726,882; and 4,454,059.

Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like are useful ashless dispersants. Exemplary materials of this kind are described in the following U.S. Pat. Nos. 3,036,003; 3,200,107; 3,254,025; 3,278,550 3,281,428; 3,282,955; 3,366,569; 3,373,111; 3,442,808 3,455,832; 3,493,520; 3,513,093; 3,539,633; 3,579,450 3,600,372; 3,639,242; 3,649,659; 3,703,536; and 3,708,522. Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants are disclosed in the following U.S. Pat. Nos. 3,329,658; 3,449,250; 3,519,565; 3,666,730; 3,687,849; and 3,702,300. All of the above-noted patents are incorporated by reference herein for their disclosures of ashless dispersants.

The carboxylic dispersants generally are reaction products of substituted carboxylic acylating agents such as substituted carboxylic acids or derivatives thereof with (a) amines characterized by the presence within their structure of at least one >NH group, (b) organic hydroxy compounds such as hydroxy aromatic compounds and alcohols, (c) basic inorganic materials such as reactive metal or reactive metal compounds, and (d) mixtures of two or more of (a) through (c). The dispersants which are obtained by the reaction of a substituted carboxylic acylating agent with an amine compound often are referred to as "acylated amine dispersants" or "carboxylic imide dispersants" such as succinimide dispersants. The ashless dispersants obtained by the reaction of a substituted carboxylic acylating agent with an alcohol or phenol generally are referred to as carboxylic ester dispersants.

The substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc. The free carboxylic acids or the anhydrides of polycarboxylic acids are preferred acylating agents.

In one embodiment, the ashless dispersants which may be utilized in the present invention are the acylated amines or dispersants obtained by reaction of a carboxylic acylating agent with at least one amine containing at least one hydrogen attached to a nitrogen group. In one preferred embodiment, the acylating agent is a hydrocarbon-substituted succinic acid acylating agent.

The nitrogen-containing carboxylic dispersants useful in the present invention are known in the art and have been described in many U.S. patents including

| | | |
|---|---|---|
| 3,172,892 | 3,341,542 | 3,630,904 |
| 3,215,707 | 3,444,170 | 3,632,511 |
| 3,219,666 | 3,454,607 | 3,787,374 |
| 3,316,177 | 3,541,012 | 4,234,435 |

The above U.S. patents are expressly incorporated herein by reference for their teaching of the preparation of nitrogen-containing carboxylic dispersants. However, when preparing carboxylic dispersants for use in the functional fluids of this invention, the prior art procedures are modified by substituting a synthetic oil for the natural oils (e.g., mineral oil) used as a diluent in the prior procedures.

In general, the nitrogen-containing carboxylic dispersants are produced by reacting at least one substituted succinic acylating agent with at least one amine compound containing at least one >HN group, and wherein said acylating agent consists of substituent groups and succinic groups wherein the substituent groups are derived from a polyalkene characterized by an Mn value (number average molecular weight) of at least about 700, and more generally from about 700 to about 5000. Generally, the reaction involves from about 0.5 equivalent to about 2 moles of the amine compound per equivalent of acylating agent.

Similarly, the carboxylic ester dispersants are prepared by reacting the carboxylic acylating agents described above with one or more alcohols or hydroxy aromatic compounds in ratios of from about 0.5 equivalent to about 2 moles of hydroxy compound per equivalent of acylating agent. The preparation of carboxylic ester dispersant is described in the prior art such as U.S. Pat. Nos. 3,522,179 and 4,234,435.

The functional fluids of the present invention also may contain suitable metal passivators or deactivators which are known in the art. This type of additive is employed to prevent or counteract catalytic effects of metal to oxidation. Typical metal deactivators include complex organic nitrogen, oxygen and sulfur-containing compounds. For copper, compounds such as benzotriazole, 5,5'-methylene-bis-benzotriazole, 2,5-dimercaptothiazole, salts of salicylaminoguanidine, and quinizarin are useful. Propylgallate is an example of a metal deactivator for magnesium and sebacic acid is an example of a deactivator for lead. The metal passivators or deactivators generally are included in the functional fluids in amounts of from about 0.01 to about 1% by weight.

Extreme pressure agents and corrosion-inhibiting and auxiliary oxidation-inhibiting agents which may be included in the functional fluids are exemplified by chlorinated aliphatic hydrocarbons such as chlorinated wax; organic sulfides and polysulfides such as benzyl disulfide, bis(chlorobenzyl) disulfide, dibutyl tetrasulfide, sulfurized methyl ester of oleic acid, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc didyclohexylphosphorodithioate, zinc dioctylphosphorodithioate, barium di(heptylphenyl) phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The following examples illustrate the lubricating compositions of the invention.

| | Parts by Weight | | | | | | | |
|---|---|---|---|---|---|---|---|---|
| Lubricant | 1 | 2 | 3 | 4 | 5 | 6 | 7 | 8 |
| Hercolube F (ester) | 88.59 | 90.99 | 45.50 | | | 47.0 | 44.0 | 89.3 |
| Hercolube A (ester) | | | | 90.79 | 90.88 | | | |
| Polyalpha olefin[1] | | | | | | 47.0 | | |
| Dow Corning-550 (silicone) | | | 45.49 | | | | | |
| Tricresyl Phosphite | | | | | | | 44.0 | |
| Phenol of B-13 | | | | | | | 6.57 | |
| Calcium Salt of B-8 | 6.4 | 7.8 | 7.8 | | | 5.0 | | 6.57 |
| 2,2'-methylinebis-(4-tetrapropenyl-6-t-butyl phenol) | | | | 8.0 | 8.0 | | | |
| phenyl alpha-naphthyl amine | 1.1 | | | | | 1.0 | 1.3 | |
| di(octyl phenyl)amine | | 1.2 | 1.2 | 1.2 | 1.1 | | | 1.1 |
| Basic calcium sulfonate of D-1 | 3.9 | | | | | | 4.1 | |
| Reaction product of polyisobutenyl succinic anhydride with polyamine mixture | | | | | | | | 3.0 |
| Tolytriazole | | | | | 0.02 | | 0.02 | 0.02 |
| Silicone anti-foam agent | 0.01 | 0.01 | 0.01 | 0.01 | 0.01 | | 0.01 | 0.01 |

[1]Mobil SHF-82

The functional fluids of the present invention can be utilized in a variety of applications, particularly where the fluid is to be subjected to very high temperatures such as above 500° F. The functional fluids are used primarily as lubricating compositions which may be utilized in a variety of applications including as crankcase lubricating oils for spark-ignited and compressionignited internal combustion engines including automobile and truck engines, two-cycle engine lubricants, aviation piston engines, marine and railroad diesel engines, etc. The fluids may also be used as gear lubricants, metal-working lubricants, hydraulic fluids, etc.

The functional fluids of the present invention are particularly useful as lubricating compositions for lubricating engines operating at high temperatures such as high temperature, low heat rejection diesel engines. In particular, the functional fluids of the present invention are useful in lubricating adiabatic internal combustion engines including adiabatic diesel engines which operate at temperatures above 260° C. in the vicinity of about 370° C. to about 540° C. or higher.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A high temperature functional fluid comprising
(A) at least about 85% by weight of a liquid synthetic base oil comprising at least one polyol ester, and at least one hydrogenated polyolefin;
(B) from about 0.1 to about 10% by weight of at least one phenolic compound selected from the group consisting of
(B-1) metal-free, hindered phenols substituted with at least one alkyl group containing at least about 6 carbon atoms, and alkylene coupled derivatives thereof;
(B-2) neutral and basic alkaline earth metal salts of hindered phenols which are not alkylene- or sulfur-coupled;
(B-3) metal-free alkyl phenol sulfides prepared by reacting an alkyl phenol with sulfur monochloride, sulfur dichloride or elemental sulfur or neutral and basic alkaline earth metal salts of said alkyl phenol sulfides; and
(B-4) neutral and basic alkaline earth metal salts of alkylene-coupled phenols prepared by reacting a phenol with an aldehyde or ketone; and
(C) from about 0.01 to about 10% by weight of at least one non-phenolic antioxidant.

2. The functional fluid of claim 1 wherein the base oil (A) comprises a mixture of from about 30 to about 90% by weight of at least one polyol ester and from about 10 to about 70% by weight of a hydrogenated polyolefin.

3. The functional fluid of claim 1 wherein the phenolic compound (B) is
(B-3) a metal-free alkyl phenol sulfide or a neutral or basic alkaline earth metal salt of an alkyl phenol sulfide.

4. The functional fluid of claim 3 wherein the phenolic compound is a basic alkaline earth metal salt of an alkyl phenol sulfide.

5. The functional fluid of claim 4 wherein the alkyl phenol sulfide of (B-3) is prepared by the reaction of an alkyl phenol with a sulfur dichloride.

6. The functional fluid of claim 5 wherein the alkyl group of the alkyl phenol contains at least about 6 carbon atoms.

7. The functional fluid of claim 5 wherein the alkyl group of the alkyl phenol is derived from a polymer of ethylene, propene or butene and contains from about 10 to 125 aliphatic carbon atoms.

8. A high temperature lubricating composition which comprises (A) at least about 85% by weight of at least one liquid synthetic base oil selected from the group consisting of polyol esters, hydrogenated polyalphaolefins, esters of aromatic phosphorus acids and mixtures thereof;

(B) from about 0.1 to about 10% by weight of at least one neutral or basic alkaline earth metal salt of an alkyl phenol sulfide prepared by reacting an alkyl phenol with sulfur monochloride, sulfur dichloride or elemental sulfur, an alkylene coupled phenol, prepared by reacting a phenol with an aldehyde or ketone or mixtures thereof; and (C) from about 0.01 to about 10% by weight of at least one non-phenolic organic antioxidant.

9. The lubricating composition of claim 8 wherein the synthetic base oil (A) comprises at least one polyol ester.

10. The lubricating composition of claim 8 wherein the base oil (A) comprises a mixture of at least one polyol ester and at least one hydrogenated polyalphaolefin, or aromatic phosphate.

11. The lubricating composition of claim 8 wherein the synthetic base oil (A) is a polyol ester which is an ester of a polyhydric alcohol and an alkanoic acid having at least 4 carbon atoms.

12. The lubricating composition of claim 8 wherein (B) is a basic alkaline earth metal salt of an alkyl phenol sulfide.

13. The lubricating composition of claim 8 wherein the alkyl phenol sulfide of (B) is prepared by the reaction of an alkyl phenol with a sulfur dichloride.

14. The lubricating composition of claim 8 wherein the antioxidant (C) comprises at least one aromatic amine.

15. The lubricating composition of claim 14 wherein aromatic amine is represented by the formula $$R^3R^4NH \qquad \text{(III)}$$

wherein $R^3$ and $R^4$ are each independently aromatic or substituted aromatic groups.

16. The lubricating composition of claim 15 wherein $R^3$ and $R^4$ are each independently phenyl, alkyl phenyl, naphthyl or alkyl naphthyl groups.

17. The lubricating composition of claim 15 wherein the aromatic amine is phenothiazine or a phenothiazine derivative of the structure

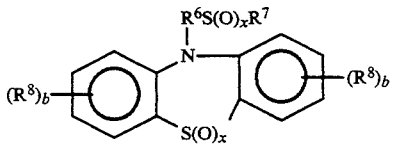

(VIII)

wherein $R^7$ is selected from the group consisting of higher alkyl groups, or an alkenyl, aryl, alkaryl or aralkyl group and mixtures thereof; $R^6$ is an alkylene, alkenylene or an aralkylene group, or mixtures thereof; each $R^7$ is independently alkyl, alkenyl, aryl, alkaryl, arylalkyl, halogen, hydroxyl, alkoxy, alkylthio, arylthio, or fused aromatic rings, or mixtures thereof; a and b are each independently 0 or greater; and x is 0, 1 or 2.

18. The lubricating composition of claim 8 wherein (B) is a neutral alkaline earth metal salt, and the lubricating composition also contains (D) at least one basic alkali metal or alkaline earth metal salt of a sulfonic or carboxylic acid.

19. The lubricating composition of claim 8 which is free of ashless dispersants.

20. The lubricating composition of claim 8 which is free of metal salts of dihydrocarbyl dithiophosphoric acids.

21. The lubricating composition of claim 18 wherein (D) is at least one basic alkaline earth metal salt of at least one organic sulfonic acid.

22. The lubricating composition of claim 8 which is useful at temperatures above about 260° C.

23. A lubricating composition useful at temperatures above about 260° C. and which comprises (A) at least about 85% by weight of a synthetic base oil which comprises at least one synthetic polyol ester;

(B) from about 0.1 to about 10% by weight of at least one basic alkaline earth metal salt of an alkyl phenol sulfide prepared by reacting an alkyl phenol with sulfur monochloride, sulfur dichloride or elemental sulfur; and (C) from about 0.01 to about 10% by weight of at least one aromatic secondary amine represented by the formula $$R^3R^4NH \qquad \text{(III)}$$

wherein $R^3$ and $R^4$ are each independently hydrocarbon-substituted aromatic groups.

24. The lubricating composition of claim 23 wherein the alkyl phenol sulfide of (B) is prepared by the reaction of an alkyl phenol with a sulfur dichloride.

25. The lubricating composition of claim 23 wherein $R^3$ and $R^4$ in Formula III are each independently phenyl, alkyl phenyl, naphthyl or alkyl naphthyl groups.

26. The lubricating composition of claim 23 also containing (D) from about 0.01 to about 10% by weight of at least one basic alkaline earth metal salt of an organic sulfonic acid.

27. The lubricating composition of claim 23 which is free of ashless dispersants.

28. The lubricating composition of claim 23 which is free of metal salts of dihydrocarbyl dithiophosphoric acid.

29. A method of lubricating engines operating at high temperatures which comprises lubricating the moving parts of the engine with the functional fluid of claim 1.

30. The method of claim 29 wherein the engine is a high temperature, low heat rejection diesel engine.

31. The method of claim 29 wherein the engine is an adiabatic diesel engine.

32. A method of lubricating engines operating at high temperatures which comprises lubricating the moving parts of the engine with the lubricating composition of claim 8.

33. A method of lubricating engines operating at high temperatures which comprises lubricating the moving parts of the engine with the lubricating composition of claim 23.

* * * * *